US010258946B2

(12) United States Patent
Buck et al.

(10) Patent No.: US 10,258,946 B2
(45) Date of Patent: Apr. 16, 2019

(54) APPLICATION SYSTEM HAVING A DYNAMIC MIXER, BATTERY-OPERATED APPLICATOR AND METHOD FOR PRODUCING AN ADHESIVE BOND

(71) Applicant: SIKA TECHNOLOGY AG, Baar (CH)

(72) Inventors: Manuel Buck, Gebenstorf (CH); David Tobler, Winterthur (CH); Dana Maiwald, Zürich (CH); Martin Schmider, Hamburg (DE)

(73) Assignee: SIKA TECHNOLOGY AG, Baar (CH)

( * ) Notice: Subject to any disclaimer, the term of this patent is extended or adjusted under 35 U.S.C. 154(b) by 1029 days.

(21) Appl. No.: 14/311,769

(22) Filed: Jun. 23, 2014

(65) Prior Publication Data

US 2014/0301153 A1 Oct. 9, 2014

Related U.S. Application Data

(63) Continuation of application No. PCT/EP2012/076775, filed on Dec. 21, 2012.

(30) Foreign Application Priority Data

Dec. 21, 2011 (EP) ..... 11194948

(51) Int. Cl.
*B01F 13/00* (2006.01)
*B05C 17/01* (2006.01)
*B05C 17/005* (2006.01)

(52) U.S. Cl.
CPC .... *B01F 13/0027* (2013.01); *B05C 17/00566* (2013.01); *B05C 17/0103* (2013.01); *B01F 2215/0039* (2013.01)

(58) Field of Classification Search
CPC ..... B01F 7/00291; B01F 7/00216; B01F 7/00766; B01F 13/002; B01F 7/00641;
(Continued)

(56) References Cited

U.S. PATENT DOCUMENTS 4,538,920 A 9/1985 Drake
5,545,460 A * 8/1996 Tanaka ..... B01F 13/002 222/145.6

(Continued)

FOREIGN PATENT DOCUMENTS

DE 3233366 A1 9/1983
DE 10164385 C1 * 3/2003

(Continued)

OTHER PUBLICATIONS

Office Action (Inquiry) dated Aug. 3, 2016, by the Russian Patent Office in corresponding Russian Patent Application No. 2014120534/05(032840), and an English Translation of the Office Action. (10 pages).

(Continued)

*Primary Examiner* — Charles Cooley
(74) *Attorney, Agent, or Firm* — Oliff PLC

(57) ABSTRACT

An application system is disclosed for two-component materials, and can include a moisture-reactive composition accommodated in a first packaging unit, a hardener component accommodated in a second packaging unit and a dynamic mixer configured for insertion into an applicator and to be driven by the applicator.

7 Claims, 5 Drawing Sheets

(58) Field of Classification Search
CPC ..... B01F 2215/0039; B01F 2215/0027; B01F 13/0027; A61C 9/0026; B05C 17/00566
See application file for complete search history.

(56) References Cited

U.S. PATENT DOCUMENTS

| | | | | |
|---|---|---|---|---|
| 6,352,177 | B1 * | 3/2002 | Bublewitz | A61C 9/0026 222/137 |
| 9,731,258 | B2 * | 8/2017 | Janssen | B01F 7/00216 |
| 9,775,691 | B2 * | 10/2017 | Gramann | A61C 9/0026 |
| 9,795,985 | B2 * | 10/2017 | Jelovac | B05C 17/005 |
| 9,981,233 | B2 * | 5/2018 | Ho | B01F 15/0226 |
| 10,086,345 | B2 * | 10/2018 | Janssen | B01F 7/00216 |
| 10,098,683 | B2 * | 10/2018 | Vogt | A61B 17/8833 |
| 2002/0175186 | A1 * | 11/2002 | Keller | B01F 7/00141 222/145.6 |
| 2003/0123323 | A1 * | 7/2003 | Bublewitz | A61C 9/0026 366/172.1 |
| 2008/0144426 | A1 * | 6/2008 | Janssen | B01F 7/00216 366/130 |
| 2008/0264971 | A1 * | 10/2008 | Harre | A61C 9/0026 222/137 |
| 2009/0279382 | A1 * | 11/2009 | Harre | A61C 9/0026 366/133 |
| 2010/0091607 | A1 * | 4/2010 | Meyer | A61C 9/0026 366/151.2 |
| 2014/0092704 | A1 | 4/2014 | Janssen et al. | |
| 2017/0239683 | A1 * | 8/2017 | Schultheiss | B05C 17/00566 |
| 2017/0304865 | A1 * | 10/2017 | Tanner | B05C 17/00566 |

FOREIGN PATENT DOCUMENTS

| | | | | |
|---|---|---|---|---|
| DE | 102006038897 | A1 * | 2/2008 | |
| EP | 0121342 | A2 | 10/1984 | |
| JP | S59-166232 | A | 9/1984 | |
| JP | 2010-512996 | A | 4/2010 | |
| WO | 2008/076941 | A1 * | 6/2008 | |
| WO | WO 2008/076941 | A1 | 6/2008 | |
| WO | WO-2017158144 | A1 * | 9/2017 | B05C 17/00566 |

OTHER PUBLICATIONS

Office Action (Notice of Reasons for Rejection) dated Dec. 6, 2016, by the Japanese Patent Office in corresponding Japanese Patent Application No. 2014-548090, and an English Translation of the Office Action. (8 pages).
Office Action (Notification of the Second Office Action) dated Jan. 10, 2017, by the Chinese Patent Office in corresponding Chinese Patent Application No. 201280063381.7, and an English Translation of the Office Action. (14 pages).
Office Action (Examination Report No. 2) dated Apr. 4, 2017, by the Australian Government IP Australia in corresponding Australian Patent Application No. 2012356788. (3 pgs).
Notification of Transmittal of Translation of the International Preliminary Report on Patentability (Form PCT/16338 and PCt/IB/373) and the Written Opinion of the International Searching Authority (Form PCT/ISA 237) dated Jul. 3, 2014, issued in corresponding International Application No. PCT/EP2012/076775. (9 pgs).
International Search Report (PCT/ISA/210) dated Feb. 7, 2013, by the European Patent Office as the International Searching Authority for International Application No. PCT/EP2012/076775.
Written Opinion (PCT/ISA/237) dated Feb. 7, 2013, by the European Patent Office as the International Searching Authority for International Application No. PCT/EP2012/076775.
Office Action (Patent Examination Report No. 1) dated Sep. 23, 2016, by the Australina Patent Office in corresponding Australian Patent Application No. 2012356788. (3 pages).
Aug. 22, 2017 Office Action issued in Chinese Application No. 201280063381.7.
Oct. 19, 2018 Office Action issued in European Application No. 12806507.5.
Nov. 28, 2018 Office Action Issued in Canadian Patent Application No. 2,859,473.
Jan. 2, 2019 Office Action Issued in European Patent Application No. 12 806 507.5.

* cited by examiner

APPLICATION SYSTEM HAVING A DYNAMIC MIXER, BATTERY-OPERATED APPLICATOR AND METHOD FOR PRODUCING AN ADHESIVE BOND

RELATED APPLICATIONS

This application claims priority as a continuation application under 35 U.S.C. § 120 to PCT/EP2012/076775, which was filed as an International Application on Dec. 21, 2011 designating the U.S., and which claims priority to European Application 11194948.3 filed in Europe on Dec. 21, 2011. The entire contents of these applications are hereby incorporated by reference in their entireties.

FIELD

The present disclosure relates to an application system for two-component materials, which includes a first component accommodated in a first packaging unit, and a second component accommodated in a second packaging unit. Furthermore, it relates to an applicator for such a system and to a method for producing an adhesive bond and/or covering made of two-component materials.

BACKGROUND INFORMATION

The processing of two-component materials for producing adhesive bonds and/or seals has been known, and is used in a very large variety of fields of technology. For the various fields of use that differ in part quite considerably with regard to the specifications in practice, different packaging configurations for the components of the system and applicators adapted thereto have been developed.

In the industrial sector, coordinated controlled systems dominate, in which primarily pumps and pneumatic conveyance devices can be used for expelling the system components out of the respective packaging units. Such systems are suitable conditionally for small series production and in general they can be not suitable for the artisanal sector.

In the artisanal sector, for example, for the preparation of adhesive bonds or seals on the construction site or in vehicle window replacement, manually operated applicators dominated, and now power grid- and battery-operated apparatuses have been available for several years. They have made the strength-sapping expulsion process considerably easier for craftsmen and they have allowed for the first time the use of larger packagings with corresponding expulsion forces; however, the range of use is limited.

Some limitations in the artisanal sector result from the chemical composition of known two-component materials and the associated physicochemical parameters and processing conditions. Thus, the systems having very high quantitative ratios of the individual components—such as 30:1 or higher, for example—can be mixed only with difficulty with sufficient precision using known apparatuses. Some systems, at least at low temperatures of less than a few degrees Celsius, which, however, should be completely mastered for artisanal use, have a viscosity that is so high that their expulsion from the packaging involves large force expenditure or current consumption. Moreover, in some known systems, the admissible "open time" (pot life) is too short, and/or the so-called "safe drive away time" (in the sector of vehicle window replacement) is long, particularly at low temperatures.

Therefore, systems made of a moisture-reactive composition and of a curing agent component to be admixed in a substantially smaller proportion have been developed by the present applicant. These systems satisfy important practical specifications in an excellent manner.

Regarding state-of-the-art, reference is moreover made to WO 2008/076941 A1, U.S. Pat. No. 5,545,460 A, DE 10 2006 038897 A1 as well as DE 101 64 385 C1.

SUMMARY

An application system is disclosed for two-component materials, comprising: a moisture-reactive composition accommodated in a first packaging unit; a curing agent component accommodated in a second packaging unit; and a dynamic mixer configured for insertion into an applicator and to be driven by the applicator.

A method for producing an adhesive bond and/or seal made of two-component materials which include a moisture-reactive composition and a curing agent component, the method comprising: providing the moisture-reactive composition in a first packaging unit; providing the curing agent component in a second packaging unit; providing a dynamic mixer; inserting the first and second packaging units into an applicator; inserting the dynamic mixer into the applicator in a predetermined position relative to the first and second packaging units, and opening the first and second packaging units; and operating the applicator for simultaneous expulsion and mixing of predetermined amounts of substance of the moisture-reactive composition and of the curing agent component, onto an adhesion or sealing site.

BRIEF DESCRIPTION OF THE DRAWINGS

Features disclosed herein will be explained using exemplary embodiments with reference to the figures, wherein features for understanding the exemplary embodiment are represented. The present invention is not limited to the depicted and described exemplary embodiments. In the drawings.

DETAILED DESCRIPTION

Figure 1:
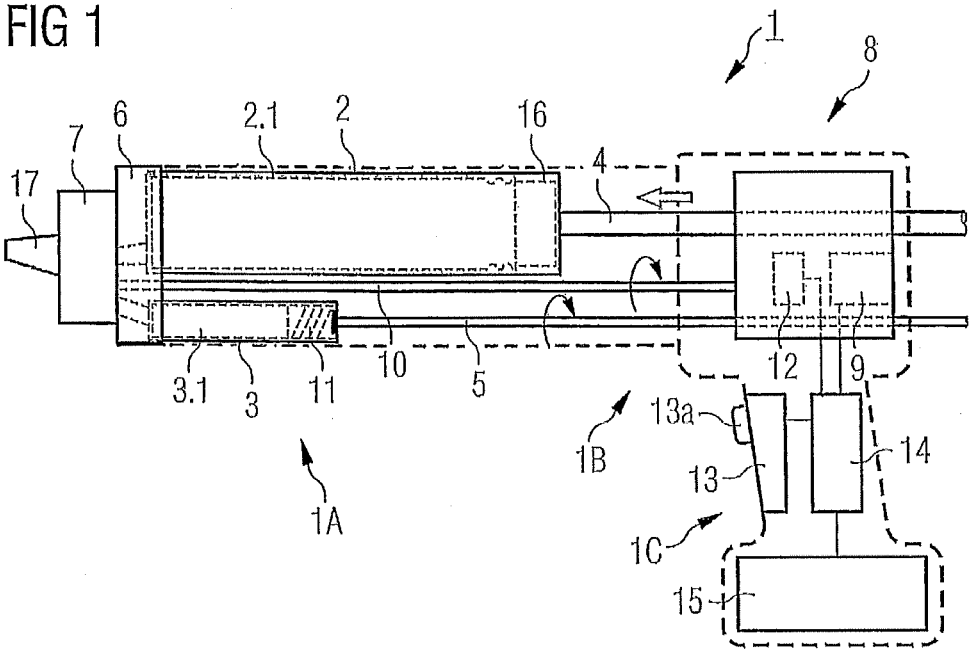
FIG. 1 shows a diagrammatic representation of an exemplary applicator according to the present disclosure in a side view in partial section.

The present disclosure describes, for artisanal use, a particularly suitable application system for two-component materials, as well as an applicator suitable for this and corresponding methods for producing an adhesive bond and/or seal.

In an exemplary application system, a dynamic mixer is used, which for example, can have at least one of the following features: a tapping element for opening the first and/or second packaging unit, two premixing chambers, and a rotor with rotor blades designed to generate an advancing motion in connection with the mixing process. The mixer also can, for example, have these features in combination.

In an exemplary embodiment, a first packaging unit is a tubular pouch, and a second packaging unit is a rigid-walled cartridge. In an exemplary embodiment, the first and second packaging units can be firmly connected to one another, and moreover plural mixers can be accommodated in a packaging that is separate from the combination of the first and second packaging units. This can take into account the circumstance that, in the case of the packaging sizes that are used in known practice, the complete processing of the packaging content of the two components can occur in several temporally separate procedures, and, at the beginning of a new processing procedure, a new mixer should be used.

A battery-operated applicator is also disclosed, which, in addition to a holder for receiving the especially configured packaging units of the system components, can include an electrical drive with battery current supply for the coordinated expulsion of the moisture-curing composition from the first packaging unit and the curing agent component from the second packaging unit as well as means for driving a dynamic mixer inserted into the applicator in the operating state. The power grid connection which reduces the flexibility of use of known applicators and makes it difficult to operate them in certain situations can thus be dispensed with.

In an exemplary embodiment, the holder of the applicator includes a first cartridge accommodation device, which is configured for receiving a first packaging unit configured as a tubular pouch, and a second cartridge accommodation device, which is configured for receiving a second packaging unit configured as a rigid-walled cartridge. Accordingly, the electrical drive can include a first expulsion rod with an expulsion piston attached thereto for expelling the moisture-reactive composition from the tubular pouch and a second expulsion rod with an expulsion piston integrated for engagement in a rigid-walled cartridge for the curing agent component, as well as a drive shaft for the dynamic mixer, all of which can be arranged on the outlet side of a transmission unit connected on the inlet side to the electric motor. In this exemplary embodiment, an applicator as disclosed herein can ensure a broad utilization of the disclosed novel two-component material in a particularly suitable packaging configuration in different application fields, such as in the field of vehicle window replacement.

In a compact and desirable configuration, the applicator can have an elongate cylindrical base body, in which, in the direction of the longitudinal axis, the holder for receiving the first and second packaging units, the first and second expulsion rods and the mixer drive shaft arranged next to one another, the transmission unit, and the electric motor can be accommodated. For example, the apparatus can have a U- or V-shaped handle, in a side view, which is arranged in a central area on the base body, and which is configured to accommodate a battery pack in an arm of the "U" or "V."

Exemplary embodiments of a proposed method result from the above-mentioned specifics of the packaging units of the moisture-reactive composition and of the curing agent component (tubular pouch or rigid-walled cartridge), and, in a further exemplary embodiment, from their structural connection to a cohesive packaging unit. An additional process aspect results from the separate provision of the mixer and, for example, plural mixers in a separate packaging, which can take account of the circumstance that the content of the packaging unit(s) can be completely consumed only with interruptions in the work, which can involve replacement of the mixer.

For example, it is provided that, in the second packaging unit, the curing agent component is provided in a volume of 5% or less, such as between 1 and 3.5%, of the volume of the moisture-reactive composition in the first packaging unit. In comparison to the substantially higher curing agent proportions used in practice to date, this can lead to reduction of the mixing power, wherein the specified precision can be ensured by an appropriate mixer construction.

In an additional exemplary embodiment of the method, the applicator can be operated with a mixer rpm in an exemplary range between 50 and 100 min-1, such as between 60 and 80 min-1, at a delivery rate of 1 ml/s. These rpm values can be entirely appropriate in practice with regard to energy consumption and useful life of the battery pack.

FIG. 1 shows a side view (in a diagrammatic representation) of an exemplary applicator 1 according to the present disclosure, wherein, as essential components, a metering and mixing device 1A and an associated drive device 1B and an apparatus body 1C can be labeled separately.

The metering and mixing device 1A can include, represented as an example, two cartridge accommodation devices 2 and 3 having different diameters and different lengths for a tubular pouch 22.1 and a rigid cartridge 3.1. The larger cartridge accommodation device 2 can be actuated by means of an axially slideable first drive piston ("linear piston") 16, which is connected to a first drive rod (toothed rack) 4, and is advanced linearly by said drive rod into the cartridge accommodation device 2. The cartridge accommodation device 3, which has a substantially smaller diameter and is moreover substantially shorter than the cartridge accommodation device 2, can be actuated according to the present disclosure by a second drive piston ("rotary piston") 11, which, on the outer side can have a thread which imprints itself into the inner wall of the cartridge accommodation device 3 or of a cartridge 23.1 inserted therein, and by its rotation generates an advance.

The drive unit 1B can includes a transmission unit 8, which, for a single drive inlet side, can have three different drive outlet sides. They can be, on the one hand, an outlet for the linearly advanced toothed rack 4, and, on the other hand, an outlet for rotating second drive rod 5, and an outlet for an also rotating drive shaft 10 which drives a rotary mixer 17. The two cartridge accommodation devices 2 and 3 can be connected on the outlet side to a cartridge coupling 6, through which the material located in the cartridge accommodation devices 2 and 3 can be conveyed from the component outlets to the rotary mixer 17, which is also connected to the cartridge coupling 6. The design of such a rotary mixer is known. It can have an expulsion tip which is attached at the front and through which mixed material can be delivered in the end.

The transmission unit 8, in the exemplary embodiment of the metering and mixing device 1 that is depicted here, is driven by an electric motor 9. Moreover, in this device a microswitch 12 can be provided to provide any desired function, whose specific function need not be described further here. The apparatus body 1C can include substantially an operating unit 13 with an on/off switch 13*a* to be operated manually, an operating control unit 14, and a battery pack 15.

Figure 2:
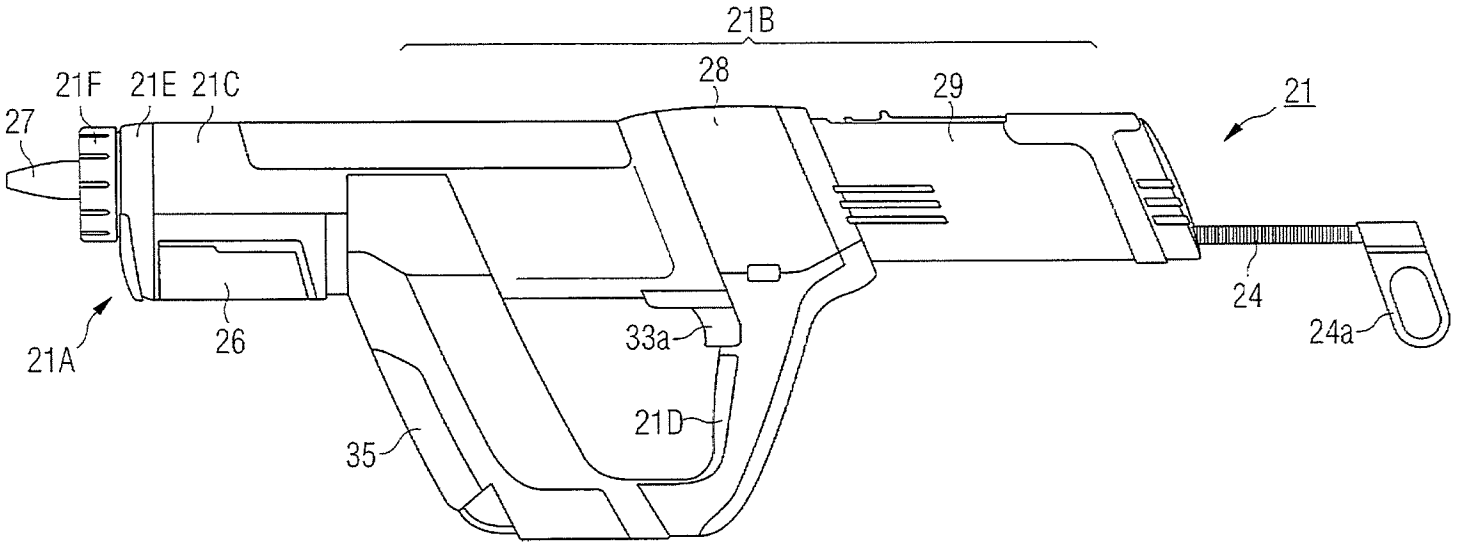
FIG. 2 shows a side view of an exemplary embodiment of an applicator.
Figure 3:
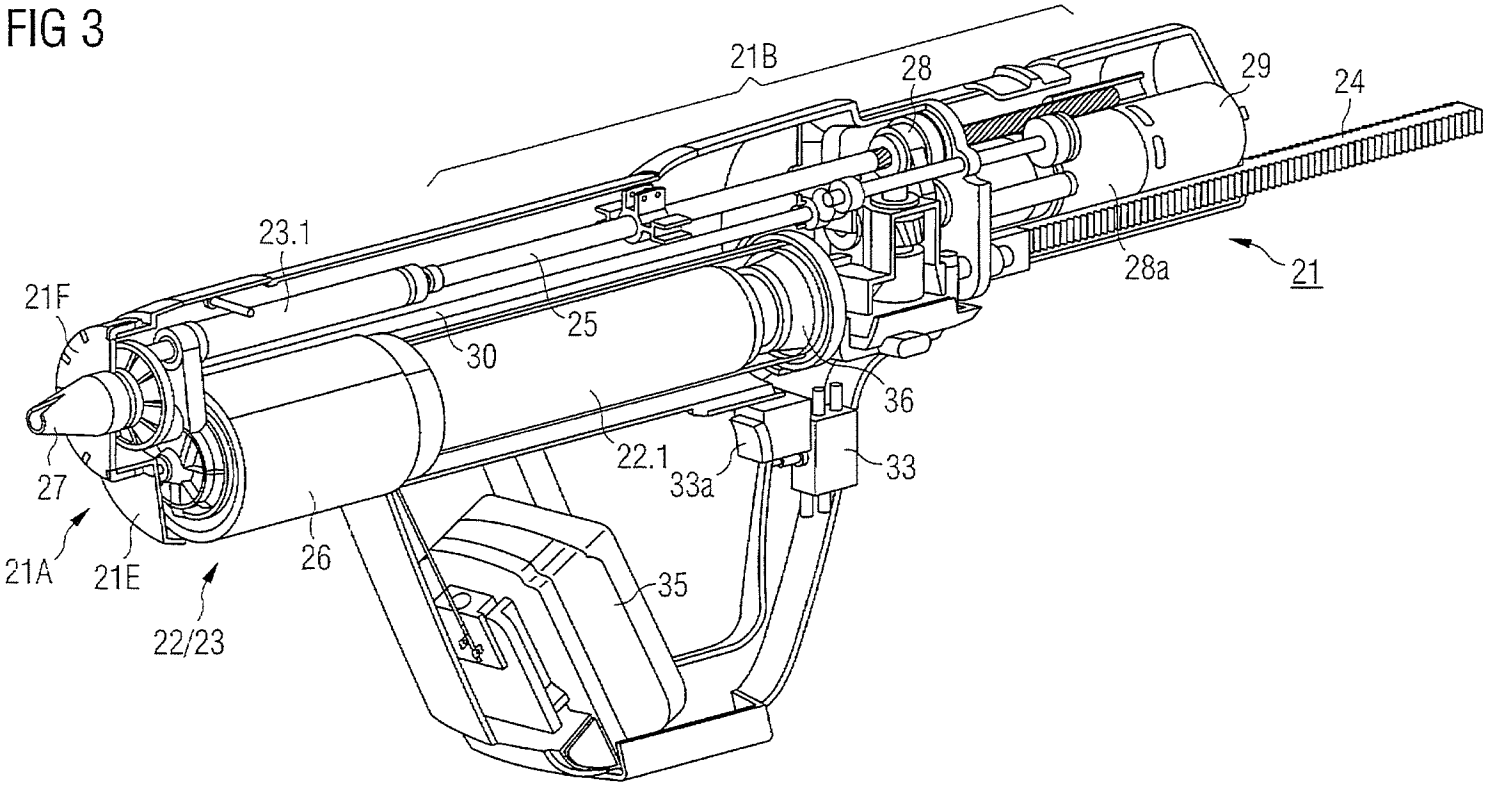
FIG. 3 shows a perspective representation of an exemplary applicator according to FIG. 2 with partially removed housing cover.

In FIGS. 2 and 3, an exemplary embodiment of a battery-operated applicator is represented in further detail, in a side view and in a perspective representation with partially removed housing portions. Parts that have an identical function compared to FIG. 1 can be marked using reference numerals based on FIG. 1 and need be not explained in further detail.

In terms of functional aspects, the applicator 21 can include a metering and mixing device 21A and a drive device 21B, which can be accommodated in a substantially elongate cylindrical apparatus body (housing) 21C. The metering and mixing device 21A here can include a cartridge accommodation device 22/23 designed and connected for holding a connected packaging unit of the adhesive system (see FIGS. 4A and 4B), which can include a tubular pouch 22.1 and a rigid-walled cartridge 23.1. A cartridge coupling 26 with a bayonet closure mechanism gives the cartridges 22.1, 23.1, delivered connected, an additional hold in the applicator and can make it easier to remove a used cartridge pack and insert a new one. As is clearer in FIGS. 4A to 5C and as described more precisely herein, in an operating state, the metering and mixing device 21A can indeed be a functional component of the applicator 21, and this can be achieved by the insertion of the cartridge pack and a dynamic mixer (rotary mixer) 27 into the apparatus housing.

The drive device 21B can include a first drive rod 24, designed as a toothed rack, to which a first piston 36 is attached for expelling the moisture-reactive composition from the tubular pouch 22.1. With a view to this function, the toothed rack 24 can also be called (first) "expulsion rod." At its end, a handle 24*a* for manual retraction during cartridge pack replacement is provided. For the expulsion of the curing agent component from the rigid-walled cartridge 23.1, a second piston (which cannot be seen in FIG. 1) integrated in the cartridge can be provided, whose structural design and function correspond substantially to those of the second drive piston (rotary piston) according to FIG. 1, and for the actuation of which a second drive or expulsion rod 25 is provided. The second piston inserted in the cartridge 23.1 and the end of the second expulsion rod 25 facing the second piston can be designed and configured in a manner so that they position themselves automatically, and the second expulsion rod 25—in contrast to the toothed rack 24—is rotatably actuated, and it sets the associated piston in a rotation which is converted by its self-cutting thread into an advance. An additional rotating drive shaft 30 can be used for driving the rotary mixer 27.

Due to an appropriate gear wheel configuration, a transmission unit 28 can be used to connect the first and second expulsion rods 24, 25 and the drive shaft 30 via a planetary gear 28*a* to a direct-current motor 29 used as drive machine for all desired apparatus functions.

For the actuation of the apparatus, an operating unit 33 with an on/off switch 33*a*, used at the same time for the rpm setting, can be provided, and a battery pack 35 can be used to supply power to the motor 29. The battery pack 35 can be accommodated in one of the two arms of a handle 21D designed in the basic shape of a "U," while the apparatus is gripped by the other arm of the "U" and accordingly the operating switch 33*a* is also arranged there. The handle 21D can be arranged on the remainder of the apparatus housing 21C in its central section, so that this apparatus will be well balanced in the hand and can therefore be handled without excessive force exertion. The accommodation of the battery pack in the front arm of the handle, for example, contributes to distribution of weight; in addition, the battery pack can be easily removed and reinserted there. For easy removal and reinsertion of the cartridge pack, a front-side closure element 21*e* can be provided at the front end of the housing apparatus and a lock nut 21*f* used for securing the mixer 27.

Figures 4A, 4B:
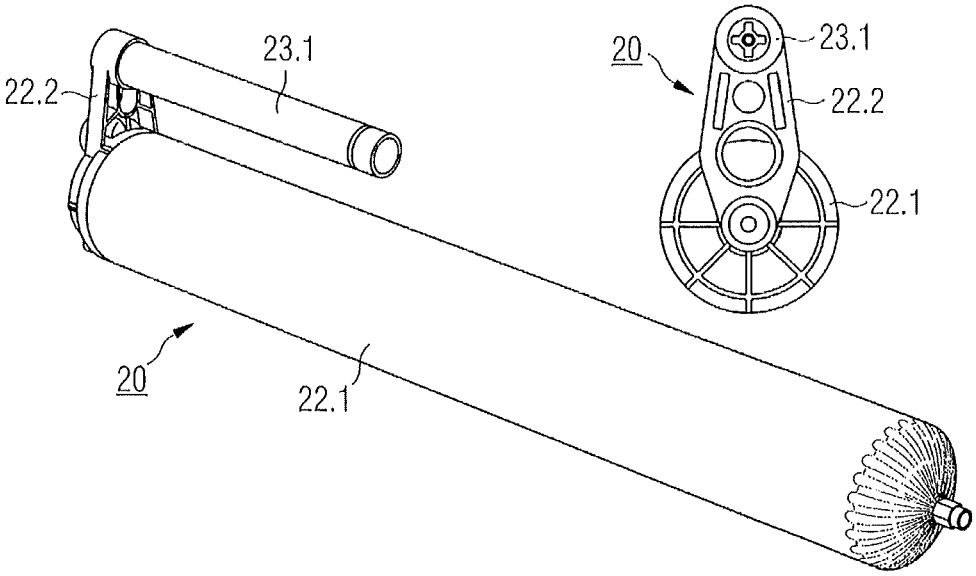
FIGS. 4A and 4B show a perspective representation and a front view of an exemplary packaging for a two-component material.

FIGS. 4A and 4B show, in a perspective representation and a front view, an exemplary tubular pouch 22.1 which is inserted in the applicator 21 according to FIGS. 2 and 3 and which can accommodate a moisture-reactive composition, and the rigid-walled cartridge 23.1 which accommodates a curing agent component, in an exemplary embodiment assembled by means of a connecting bracket 22.2 to form a packaging and delivery unit 20.

Figures 5A, 5B, 5C:
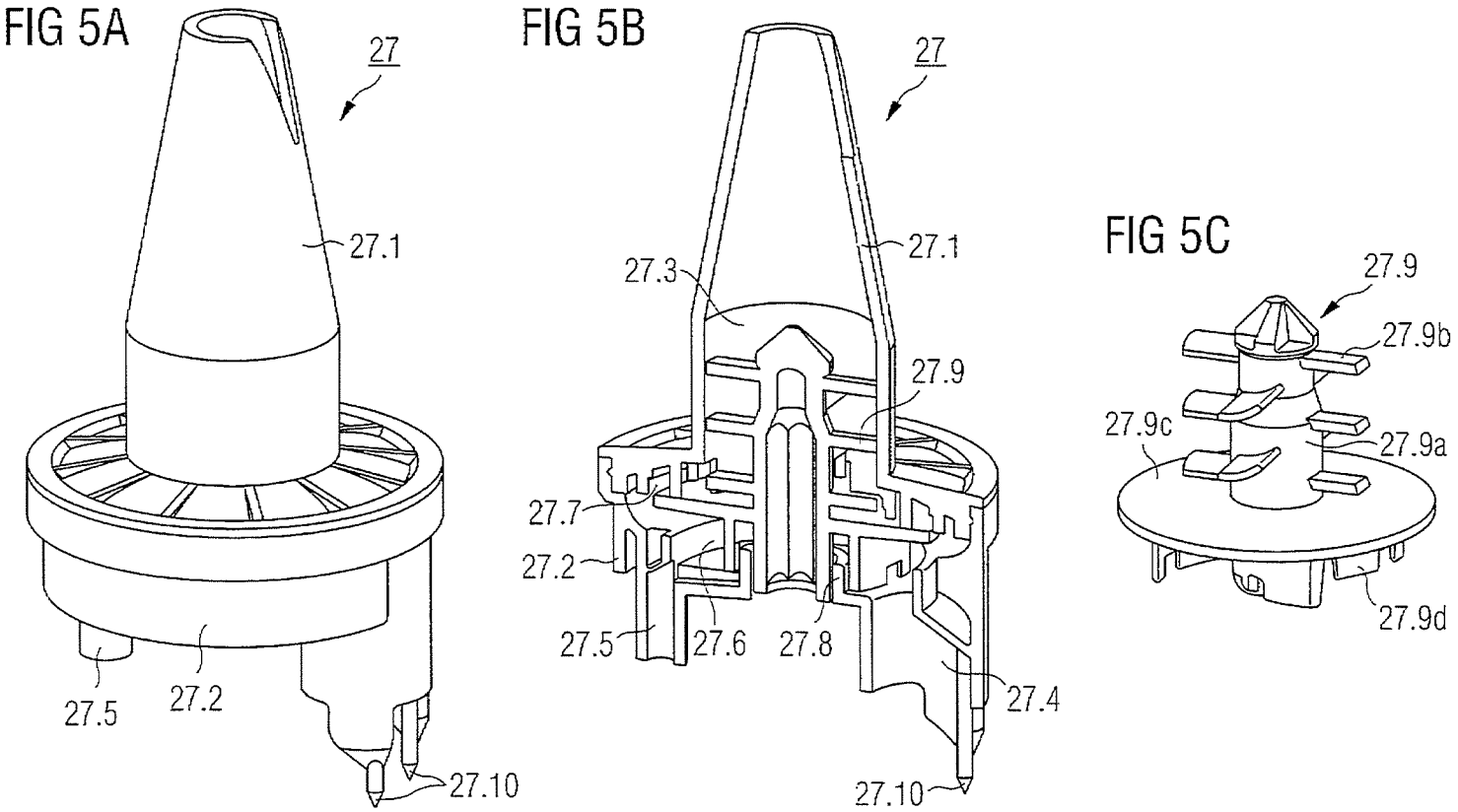
FIGS. 5A to 5C show a perspective representation, a cross-sectional view, and a detail representation of an exemplary embodiment of a dynamic mixer which can be used with an applicator according to FIGS. 1 to 3.

FIGS. 5A to 5C more precisely show the exemplary mixer 27 which can be used according to FIGS. 2 and 3 in the applicator 21, for example in a perspective view, a perspective cross-sectional representation and a detail view. In a plastic housing assembled from two plastic parts 27.1, 27.2, on the one hand, a main mixing chamber 27.3 with conically converging delivery section and, on the other hand, two component inlets 27.4, 27.5 for the two components of the two-component system, a first and a second premixing chamber 27.6, 27.7, and a bearing section 27.8 of a rotor 27.9 of the mixer can be formed. On the plastic part 27.2, tapping element or punches 27.10 can be molded for opening the packaging unit when the mixer is inserted into the apparatus.

Rotor 27.9, as can be seen in FIG. 5B, is hollow on the inside, and an engagement section (for example, hexagonal, not drawn separately) for the drive shaft 30 of the applicator (see FIG. 3) can be molded into the rotor. As can be seen best in FIG. 5C, several groups of rotor blades 27.9*b* can be molded on the outer surface of the stepped cylindrical rotor body 27.9*a*, for mixing and simultaneously conveying the material through the main mixing chamber 27.3, and in the rear area, a rotary disk 27.9*c* can be molded. In the state where the rotor is mounted in the mixer housing, this disk partially partitions the second premixing chamber from the main chamber. On the side of the rotation surface 27.9*c* facing away from the rotor section with the blade elements, curved, approximately radially extending projections 27.9*d* can be formed, which can act as mixing elements in the first premixing chamber.

Embodiments disclosed herein are not limited to these examples; instead, numerous variations are possible and within the ability of those skilled in the art.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. An application system for two-component materials, comprising:

a moisture-reactive composition accommodated in a first packaging unit;

a curing agent component accommodated in a second packaging unit;

a first cartridge accommodation device configured to hold the first packaging unit;

a second cartridge accommodation device configured to hold the second packaging unit; and a dynamic mixer configured for insertion into an applicator and to be driven by the applicator, wherein:

the first packaging unit is a tubular pouch and the second packaging unit is a rigid-walled cartridge, the first cartridge accommodation device is actuated by a linear piston connected to a linearly advanced toothed rack, and the second cartridge accommodation device is actuated by a rotary piston connected to a rotating drive rod.

2. The application system according to claim 1, wherein the dynamic mixer comprises:

at least one tapping element for opening the first and/or second packaging unit(s);

two premixing chambers; and a rotor with rotor blades configured for producing an advance in connection with a mixing process.

3. The application system according to claim 1, wherein the first and second packaging units are firmly connected to one another.

4. The application system according to claim 1, wherein the applicator is battery-operated and comprises:

a holder for accommodating the first and second packaging units; and an electrical drive with a battery current supply, which is configured for coordinated and metered expulsion of the moisture-curing composition from the first packaging unit and of the curing agent component from the second packaging unit as well as for driving the dynamic mixer inserted into the applicator.

5. The application system according to claim 4, wherein the holder comprises:

the first cartridge accommodation device; and the second cartridge accommodation device, and wherein the electrical drive comprises:

the linearly advanced toothed rack as a first expulsion rod with the linear piston connected thereto for expelling the moisture-reactive composition from the tubular pouch;

the rotating drive rod as a second expulsion rod with the rotary piston connected thereto and integrated for engagement in the rigid-walled cartridge for the curing agent component; and a drive shaft for the dynamic mixer, wherein the linearly advanced toothed rack, the rotating drive rod, and the drive shaft for the dynamic mixer arranged on an outlet side of a transmission unit, the transmission unit being connected on an inlet side to an electric motor.

6. The application system according to claim 5, comprising:

an elongate cylindrical housing in which are arranged, one after the other in a direction of a longitudinal axis, the holder for receiving the first and second packaging units, the first and second expulsion rods in an adjacent arrangement, the transmission unit, and the electric motor.

7. The application system according to claim 6, comprising:

a handle which, in side view, is U- or V-shaped, and is arranged in a central section on a base body, and which is configured for accommodating a battery pack in an arm of the "U" or "V."

* * * * *